US006070410A

United States Patent [19]

Dean

[11] Patent Number: 6,070,410

[45] **Date of Patent: *Jun. 6, 2000**

[54] LOW EMISSIONS COMBUSTOR PREMIXER

[75] Inventor: Anthony John Dean, Scotia, N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/919,018

[22] Filed: Aug. 27, 1997

Related U.S. Application Data

[63] Continuation of application No. 08/545,438, Oct. 19, 1995, Pat. No. 5,822,992.

[51] Int. Cl.[7] ..... F02C 1/00

[52] U.S. Cl. ..... 60/737; 60/748

[58] Field of Search ..... 60/737, 738, 742, 60/39.463, 748; 239/434, 419.3

[56] References Cited

U.S. PATENT DOCUMENTS

| | | | |
|---|---|---|---|
| 3,703,259 | 11/1972 | Sturgess et al. | 60/742 |
| 3,853,273 | 12/1974 | Bahr et al. | 60/748 |
| 4,271,675 | 6/1981 | Jones et al. | 60/737 |
| 4,373,325 | 2/1983 | Shekleton | 60/737 |
| 4,526,322 | 7/1985 | Voorheis | 239/404 |
| 4,967,561 | 11/1990 | Bruhwiler et al. | 60/737 |
| 5,165,241 | 11/1992 | Joshi et al. | 60/737 |
| 5,201,181 | 4/1993 | Ohmori et al. | 60/737 |
| 5,295,352 | 3/1994 | Beebe et al. | 60/742 |
| 5,365,738 | 11/1994 | Etheridge | 60/748 |
| 5,435,126 | 7/1995 | Beaudoin | 60/737 |
| 5,822,992 | 10/1998 | Dean | 60/737 |

FOREIGN PATENT DOCUMENTS 3913124 12/1989 Germany .

OTHER PUBLICATIONS

Odgers, J. et al., "Gas Turbine Fuels and Their Influence on Combustion," pp. 152–153, 1986.

*Primary Examiner*—Ted Kim

*Attorney, Agent, or Firm*—Patrick K. Patnode; Marvin Snyder

[57] ABSTRACT

A low emissions combustor includes a premixer for premixing liquid fuel and compressed air for achieving low NOx emissions without water or steam injection. The premixer includes a centerbody disposed in a shroud defining an annular flow channel extending between an inlet and outlet of the shroud. A plurality of fuel injection orifices are spaced circumferentially around the centerbody with each having an outlet being substantially flush with an outer surface of the centerbody. The fuel injection orifices inject liquid fuel into the flow channel wherein it is atomized by compressed air channeled through the shroud inlet. In a preferred embodiment, the fuel injection orifices are inclined at an acute angle for injection the fuel toward the shroud inlet to increase differential mixing velocity with the compressed air.

6 Claims, 3 Drawing Sheets

LOW EMISSIONS COMBUSTOR PREMIXER

This application is a continuation of application Ser. No. 08/545,438, filed Oct. 10, 1995, now U.S. Pat. No. 5,822,992.

BACKGROUND OF THE INVENTION

The present invention relates generally to gas turbine engines, and, more specifically, to industrial power generation gas turbine engines having low exhaust emissions.

An industrial power generation gas turbine engine typically includes a single rotor shaft joining a compressor to a turbine, with the turbine powering both the compressor and an external load typically in the form of an electrical generator. The engine is typically designed for efficient operation over a range of output power also known as load points. Most efficient operation is preferred at maximum rated power, or the base load, during which the engine is operated typically for a majority of its operating time. The full speed, no load condition allows the electrical generator to connect and disconnect from the electrical power grid. And, part load operating points exist therebetween.

Federal Environmental Protection Agency (EPA) regulations exist for ensuring that exhaust emissions from operation of the engine are below specified levels. Typical emissions include NOx, CO, and unburned hydrocarbons (UHC). Since turbines may be operated using either a gaseous fuel such as natural gas, or a liquid fuel such as No. 2 fuel oil separate emissions specifications have been promulgated due to the inherently different operation thereof. For example, natural gas is a much cleaner burning fuel and the low NOx limit specified therefor is 25 parts per million (ppm). Whereas, for liquid fuel, the low NOx limit is about 42 ppm, since liquid fuels do not burn as cleanly.

In order to achieve the low NOx level for liquid fuel, current gas turbine engines require the use of water injection either in its liquid or steam phase into the fuel and air mixture prior to undergoing combustion. Water injection accordingly increases the cost and complexity of the gas turbine engine.

SUMMARY OF THE INVENTION

A low emissions combustor includes a premixer for premixing liquid fuel and compressed air for achieving low NOx emissions without water or steam injection. The premixer includes a centerbody disposed in a shroud defining an annular flow channel extending between an inlet and outlet of the shroud. A plurality of fuel injection orifices are spaced circumferentially around the centerbody with each having an outlet being substantially flush with an outer surface of the centerbody. The fuel injection orifices inject liquid fuel into the flow channel wherein it is atomized by compressed air channeled through the shroud inlet. In a preferred embodiment, the fuel injection orifices are inclined at an acute angle for injecting the fuel toward the shroud inlet to increase differential mixing velocity with the compressed air.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
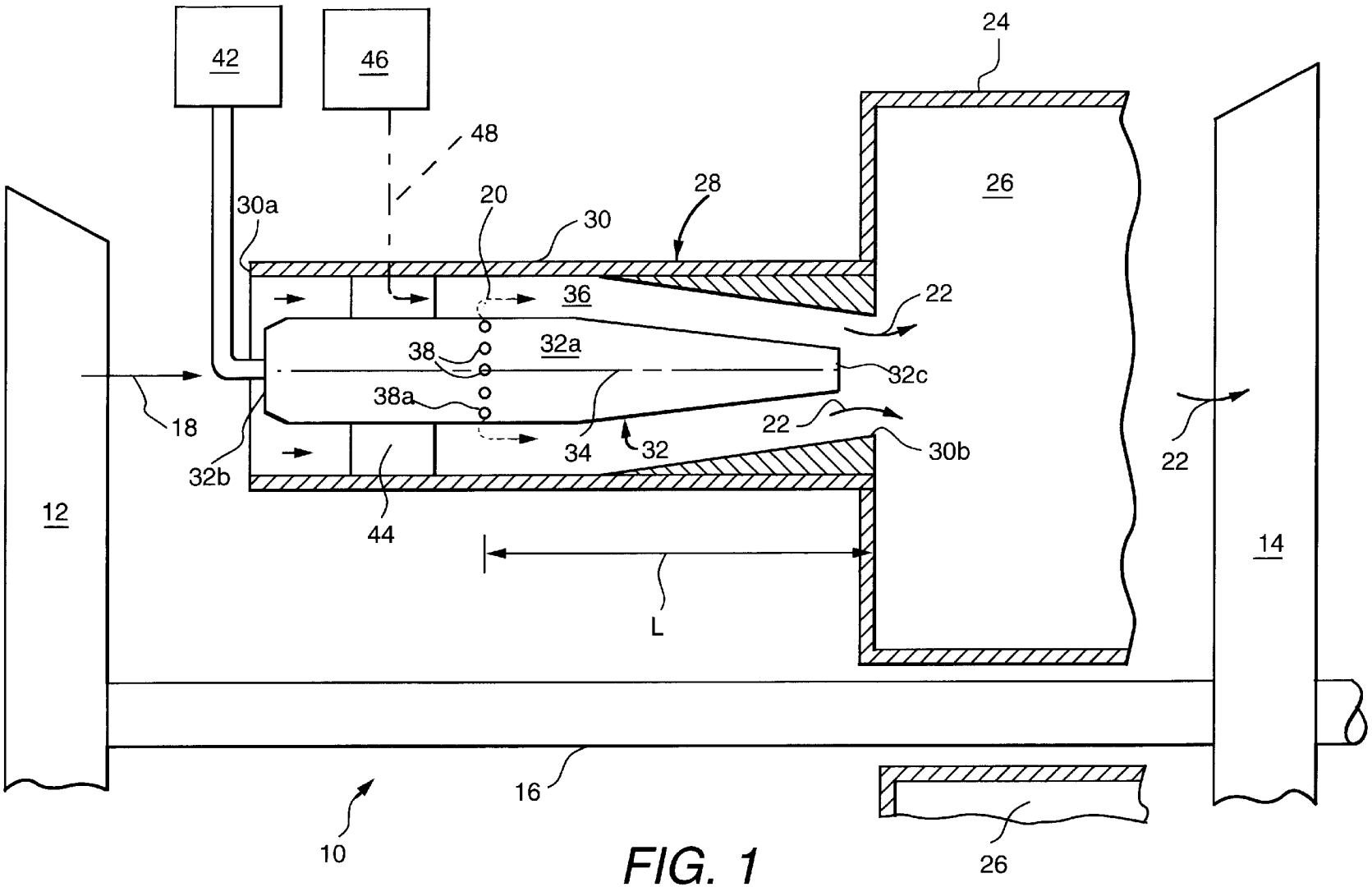
FIG. 1 is a schematic representation, partly in section, of an industrial power generation gas turbine engine including a low emissions combustor having a plurality of liquid fuel and air premixers joined thereto.

Illustrated schematically in FIG. 1 is a portion of an exemplary industrial power generation gas turbine engine 10. The engine 10 includes a conventional axial compressor 12 joined to and powered by a conventional turbine 14 by a rotor shaft 16 extending therebetween. The shaft 16 is also joined to a load such as an electrical generator (not shown) for producing electrical power, to a utility grid for example, using the power generated by the engine 10. The engine 10 is therefore conventionally operated at various load points including base load, full speed-no load, and part load thereinbetween.

Power is generated by mixing compressed air 18 discharged from the last stage of the compressor 12 at compressor discharge pressure with a conventional liquid fuel 20 such as No. 2 fuel oil, and conventionally igniting the mixture for creating combustion gases 22 inside a low emissions combustor 24 in accordance with the present invention. The combustion gases 22 are conventionally channelled to the turbine 14 which extracts energy therefrom for rotating the shaft 16 and powering both the compressor 12 and the external load or generator.

In the exemplary embodiment illustrated in FIG. 1, the combustor 24 includes a plurality of circumferentially spaced apart burner cans each defining a respective combustion chamber 26 in which the fuel and air mixture is conventionally ignited for generating the combustion gases 22. Each burner can typically includes a plurality of individual premixers 28 joined to the upstream ends thereof in which the fuel and air are premixed and prevaporized in accordance with the present invention for providing the corresponding mixture to the chamber 26 for undergoing low emissions combustion. FIG. 1 illustrates schematically an exemplary one of the premixers 28 joined to the combustion chamber 26, with multiple premixers 28 typically being used for each burner can.

Each premixer 28 includes an annular outer casing or tubular shroud 30 having an inlet 30*a* at an upstream end disposed in flow communication with the compressor 12 for receiving the compressed air 18 therefrom. The shroud 30 has an outlet 30*b* at an opposite, downstream end which is suitably fixedly joined to the combustion chamber 26. Disposed inside the shroud 30 is an annular centerbody 32 disposed coaxially with the shroud 30 about a common axial centerline axis 34 which is spaced radially outwardly from and is parallel to the axial centerline axis of the engine extending through the shaft 16. The centerbody 32 has a smooth outer surface 32*a* which extends axially between upstream and downstream ends 32*b* and 32*c* of the centerbody 32. The centerbody outer surface 32*a* is spaced radially inwardly from the inner surface of the shroud 30 to define an annular shroud flow channel 36 extending axially from the shroud inlet 30*a* to the shroud outlet 30*b*.

In accordance with the present invention, a plurality of fuel injection orifices 38 are spaced circumferentially apart around the outer surface 32*a* of the centerbody 32, and each orifice 38 has an outlet 38*a* which is preferably substantially flush or coextensive with the centerbody outer surface 32*a* to prevent any obstruction of flow through the channel 36.

The orifices 38 are axially positioned between the shroud inlet 30*a* and the shroud outlet 30*b* and axially between the upstream and downstream ends 32*b,c* of the centerbody 32 for defining an annular premixing region in the flow channel 36 extending to the shroud outlet 30*b* and having a preselected axial length L. The premixing portion of the flow channel 36 is unobstructed to prevent flameholding capability inside the shroud 30, with the outer surface 32*a* of the centerbody 32 and the inner surface of the shroud 30 being smooth.

The premixing region of the flow channel 36 may have any conventional configuration including the converging configuration illustrated in FIG. 1 wherein the aft end of the centerbody 32 converges relative to its cylindrical upstream portion in which the injection orifices 38 are disposed, and with the inner surface of the aft end of the shroud 30 similarly converging to the shroud outlet 30*b*. The centerbody downstream end 32*c* is preferably flat or bluff to provide bluff body recirculation downstream thereof and adjacent to the shroud outlet 30*b* for providing flameholding of the combustion gases 22 in the combustion chamber 26. The combustion chamber 26 also increases abruptly in size at the shroud outlet 30*b* for providing desired recirculation zones within the chamber 26 itself in a conventionally known manner.

The fuel outlets 38*a* are spaced axially upstream from the shroud outlet 30*b* and the combustion chamber 26 so that the length L of the premixing region of the flow channel 36 is effective to maximize the conventionally known ignition delay time to prevent autoignition of the premixed fuel and air in the shroud 30 while maximizing the premixing and prevaporization of the liquid fuel 20. Accordingly, the premixing region length L is made as large as possible for maximizing premixing and prevaporization, but not too large for allowing autoignition to occur within the shroud 30 which could lead to a substantial shortening of the life of the premixer 28.

Figure 2:
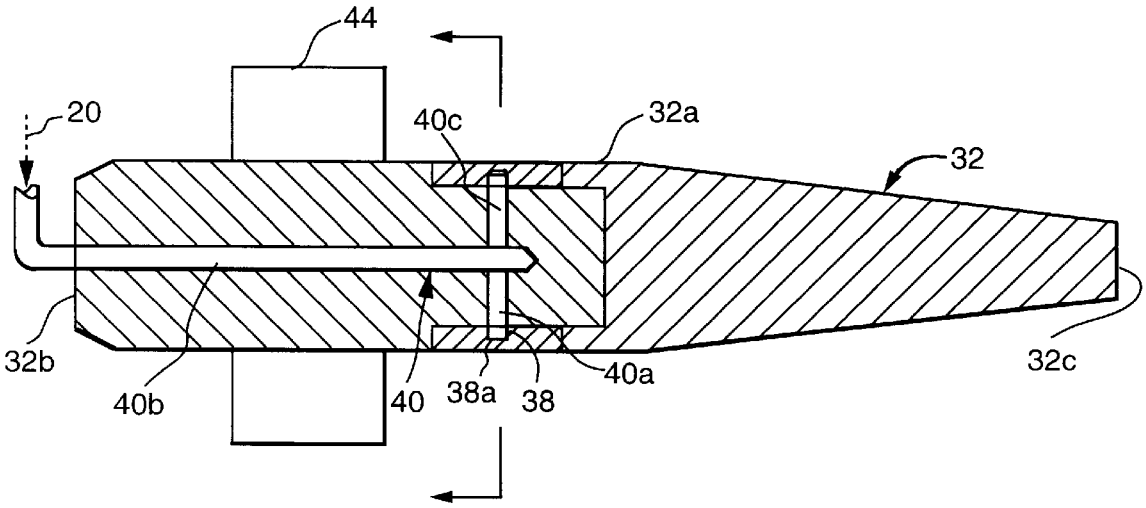
FIG. 2 is a partly sectional axial view of a centerbody and surrounding air swirler found in the premixer illustrated in FIG. 1.
Figure 3:
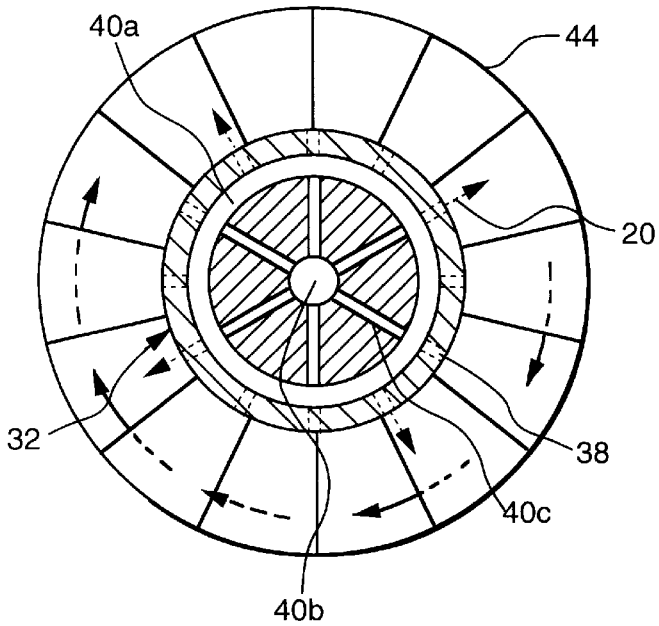
FIG. 3 is a radial, partly sectional view through the centerbody illustrated in FIG. 2 and taken along line 3—3.
Figure 4:
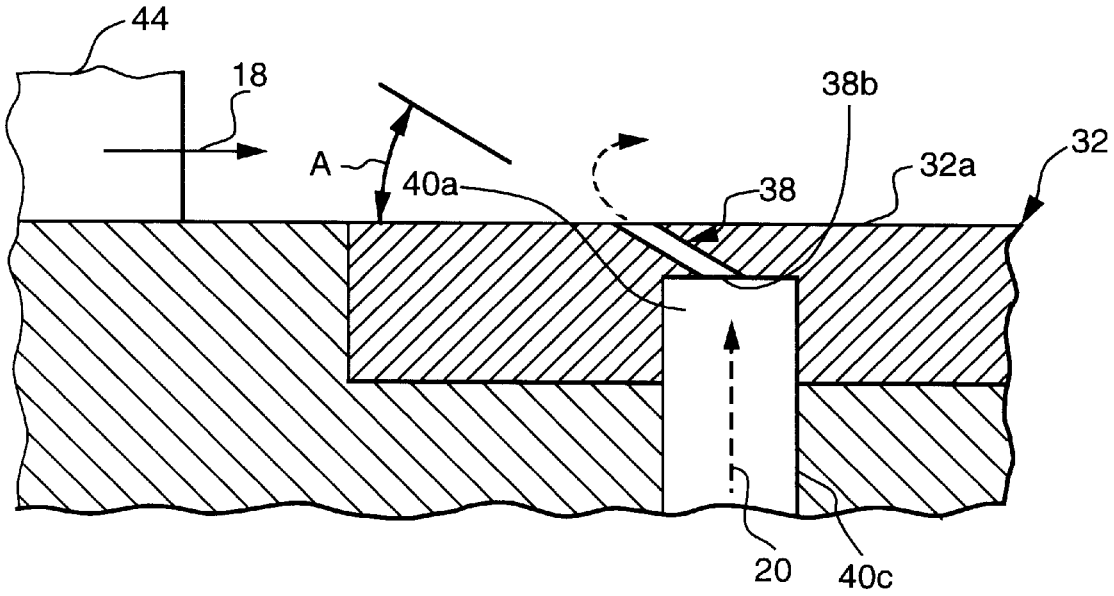
FIG. 4 is an enlarged, axial view of a portion of the centerbody illustrated in FIG. 2 showing in more detail an exemplary one of a plurality of circumferentially spaced apart fuel injection orifices for injecting liquid fuel into the premixer downstream of the swirler therein.

FIG. 2 illustrates the centerbody 32 in axial cross section; FIG. 3 illustrates a radial sectional view through the centerbody 32 at the inlet plane of the several orifices 38; and FIG. 4 is an enlarged axial sectional view through an exemplary one of the orifices 38. The flush orifice outlet 38*a* is clearly shown in FIG. 4 coextensive with the centerbody outer surface 32*a*. Each of the orifices 38 also includes an inlet 38*b* at an opposite end of the orifice 38 disposed radially inside the centerbody 32 below the outer surface 32*a*.

As illustrated in FIGS. 2 and 3, suitable means in the exemplary form of a fuel supply circuit 40 extend inside and partially through the centerbody 32 in flow communication with the fuel injection orifices 38 for supplying the liquid fuel 20 to the orifices 38 for discharge or ejection therefrom into the flow channel 36 illustrated in FIG. 1 for premixing with the compressed air 18 and prevaporizing prior to discharge from the shroud outlet 30*b* into the combustion chamber 26. In the preferred embodiment illustrated in FIGS. 2 and 3, the fuel supply circuit 40 channels solely the liquid fuel 20 without any additional atomizing air to the orifices 38. It includes an annular manifold 40*a* disposed coaxially in the centerbody 32 below the outer surface 32*a* in flow communication with the respective inlets 38*b* of the several fuel injection orifices 38.

The circuit 40 further includes a center coaxial channel or bore 40*b* extending partly in the centerbody 32 for channeling the fuel 20 therein from conventional means 42, shown in FIG. 1, for supplying the fuel 20. The fuel supply 42 includes a suitable fuel tank, conduits, and regulation valves as warranted for providing the fuel 20 under suitable pressure and at suitable flow rates into each of the centerbodies 32. The circuit 40 further includes a plurality of fuel spokes 40*c* as illustrated in FIGS. 2–4 which are cylindrical bores extending radially outwardly from the center bore 40*b* in flow communication therewith to the manifold 40*a* for distributing the fuel 20 to the manifold 40*a* and in turn through the several fuel injection orifices 38. The fuel supply circuit 40 not only channels the liquid fuel 20 through the centerbody 32, but also provides cooling of the centerbody 32 using the fuel 20 as a heat sink.

The fuel injection orifices 38 illustrated in FIG. 4 for example are very simple and plain in construction since they are mere holes extending into the centerbody 32, with the orifice outlets 38*a* being flush with the centerbody outer surface 32*a*. The orifices 38 preferably do not extend radially outwardly into the flow channel 36 to prevent flow obstruction therein, and eliminate any flow blockage which could otherwise act as a flameholder within the premixer 28. Accordingly, the risk of damage to the premixer 28 due to spontaneous or autoignition of the liquid fuel 20 during operation at high temperature is minimized or eliminated because the fuel injection orifices 38 provide no structure for holding a combustion flame inside the shroud 30. In a conventional premixer having radially projecting fuel injectors, water or steam injection is required for preventing undesirable autoignition in the premixer itself and for obtaining suitably low emissions from the combustor for meeting the EPA requirements.

Furthermore, conventional liquid fuel injectors typically also use a separate source of atomizing air to disperse or atomize liquid fuel droplets into sufficiently small droplets which can be more completely burned for reducing undesirable exhaust emissions. In the present invention however, a separate source of atomizing air is not required for atomization of the liquid fuel 20 discharged through the orifices 38. The shroud inlet 30*a* is disposed in flow communication with the high pressure, high velocity compressed air 18 discharged from the compressor 12 which air itself is used for atomizing the liquid fuel 20 discharged from the orifices 38. The use of the compressor discharge air itself provides good turndown performance of the engine 10 since the compressor discharge air has a relatively constant velocity over the load range of the engine 10, with the compressed air 18 providing the necessary shear force for effective atomization of the liquid fuel 20. Atomization of the fuel 20 is further enhanced by additionally providing a conventional air swirler 44, as illustrated in FIG. 1 for example, which extends radially between the centerbody 32 and the shroud 30, and is axially disposed between the shroud inlet 30*a* and the fuel injection orifices 38. The swirler 44 includes a plurality of circumferentially spaced apart angled vanes which impart swirling or helical flow to the compressed air 18 channeled therebetween prior to mixing with the injected fuel 20 discharged from the orifices 38.

In order to reduce the droplet size of the liquid fuel 20 ejected from the orifices 38, it is preferable that a suitable number of relatively small diameter orifices 38 be distributed around the circumference of the centerbody outer surface 32*a*. In one embodiment tested, there were twelve orifices 38 equally spaced apart around the circumference of the centerbody 32, with each orifice 38 having a diameter of about 20 mils. Furthermore, by injecting the liquid fuel 20 into the high velocity stream of the compressor discharge air 18 channeled through the shroud 30, the relative velocity between the injected fuel and the air stream is very high and provides shear stress to further reduce the droplet size of the fuel 20. In this way, droplet size may be reduced without the use of a separate source of atomizing air as found in the prior art, with such separate atomizing air also being typically provided at a higher pressure than that of the compressor discharge pressure. In a conventionally liquid fueled industrial power generation gas turbine engine, an auxiliary compressor is typically required to boost compressor discharge air to further higher pressure for use in an atomizing fuel injection nozzle. This additional complexity and equipment may therefore be eliminated by using the plain orifices 38 as disclosed.

In order to further reduce the droplet size of the fuel 20 discharged from the orifices 38, the orifices 38 are preferably inclined or angled in the upstream air direction at an acute angle A toward the centerbody upstream end 32*b*, as shown in FIG. 4. In this way, the inclined orifices 38 are effective for injecting the fuel 20 toward the shroud inlet 30*a* as shown in FIG. 1 to increase the differential or relative mixing velocity between the fuel 20 and the air 18. The acute inclination angle A may vary within the range of 15° to 90° relative to the centerbody axis 34, with an angle of 30° being particularly effective for reducing droplet size. Accordingly, the fuel 20 is highly atomized upon discharge from the orifices 38 and undergoes premixing with the compressed air 18 in the premixing region of the flow channel 36, with prevaporization of the fuel also occurring in this elevated temperature region. The resulting premixed and prevaporized fuel and air mixture channeled into the combustion chamber 26 is then conventionally ignited to form the combustion gases 22 having significantly low emissions.

In one exemplary embodiment tested, the length L of the premixing region of the flow channel 36 was about 7 inches, the outer diameter of the centerbody 32 at the orifices 38 was about 2 inches, and the inner diameter of the shroud 30 above the orifices was 4 inches. The orifices 38 were inclined upstream toward the air stream at an angle A of about 30°. The pressure drop across the fuel injection orifices 38 was about 70 psi with a conventional flow number of about 26. With the use of the swirler 44, the relative or differential velocity between the injected fuel 20 and the compressed air 18 in the flow channel 36 was about 200 feet per second which produced atomized fuel drops similar to those obtained from a conventional air-atomizing fuel injector. The relatively low, 30° angle of the orifices 38 initially keeps the injected fuel near the centerbody 32, with the droplets then being evenly distributed by the swirling airflow.

Experiments with and without an upstream swirler 44 show that atomization and fuel distribution is better with swirl in the flow for this combination of fuel injection angle and axial air velocity. Laboratory scale combustion experiments of premixing and prevaporizing liquid fuel using the plain orifices 38 in the premixer 28 show low NOx levels less than the EPA threshold of about 42 ppm, corrected to 15% excess oxygen. For an equivalence ratio between about 0.42 and 0.54, which is a lean fuel and air mixture, low NOx less than about 25 ppm down to about 15 ppm was obtained. The significantly low NOx values were obtained using liquid fuel, and most significantly, were characterized by the absence of any water or steam injection into the fuel and air mixture as is required in conventional low NOx liquid fueled combustors. Furthermore, significantly low carbon monoxide levels less than about 25 ppm, corrected at 15% oxygen, were also obtained for this equivalence ratio range. And, combustion efficiency greater than about 99.99% was also obtained for this equivalence range indicating a substantially low level of unburned hydrocarbons (UHC).

Another significant advantage of the present invention is that the premixer 28 now permits dual fuel operation because the fuel injection orifices 38 do not have the capability to hold a flame when natural gas is injected upstream therefrom. As shown in FIG. 1, optional means 46 may be provided for injecting a second, gaseous fuel such as natural gas 48 into the shroud flow channel 36 at any suitable location upstream of the fuel injection orifices 38 for obtaining dual fuel operation of the combustor 24 without undesirable flameholding adjacent to the fuel injection orifices 38. The plain orifices 38 are resistant to autoignition or flashback. The gas injecting means 46 may take any conventional form including a suitable gas supply, conduits, valves, and suitable injectors which may be positioned near the air swirler 44, or be integrally formed within the individual vanes thereof as desired. The gaseous fuel 48 provides a combustible fuel and air mixture upstream of the liquid fuel injectors 38, which mixture is therefore subject to combustion. Since the orifices 38 are plain, they do not provide flameholding capability and therefore the risk of damage to the premixer 28 due to flashback or autoignition of either the liquid fuel 20 or the gaseous fuel 48 is minimized.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A pre-mixer for pre-mixing a liquid fuel and compressed air for flow to a gas turbine engine low Nox combustion chamber for combustion absent steam or water injection and atomizing air, said pre-mixer comprising:

a tubular shroud having an inlet at one end thereof for receiving said compressed air, and an outlet at an opposite end thereof;

a centerbody having an outer surface and disposed coaxially in said shroud and spaced radially inward therefrom to define a flow channel from said shroud inlet to said shroud outlet;

a plurality of fuel injection orifices spaced circumferentially apart around said centerbody and each having an outlet being substantially flush with said centerbody outer surface;

a fuel supply circuit extending in said centerbody in flow communication with said fuel injection orifices for supplying said liquid fuel to said orifices for discharge therefrom into said flow channel for pre-mixing said fuel with said compressed air prior to discharge from said shroud outlet and into said gas turbine engine low Nox combustion chamber for combustion absent steam or water injection and atomizing air;

wherein said fuel supply comprises an annular manifold disposed in said centerbody in flow communication with said fuel injection orifices, a center bore extending in said centerbody for channeling said fuel, and a plurality of fuel spokes extending radially outwardly from said center bore to said manifold for distributing said fuel to said manifold and;

wherein said fuel injection orifices are inclined at an acute angle with respect to said centerbody outer surface for injecting said fuel toward said shroud inlet to increase differential mixing velocity with said compressed air.

2. A premixer in accordance with claim 1, wherein said fuel injection orifices are inclined at an angle of about 30°.

3. A premixer in accordance with claim 1, further comprising an air swirler extending radially between said centerbody and said shroud and axially between said shroud inlet and said fuel injection orifices for swirling said compressed air prior to mixing with said injected fuel discharged from said fuel injection orifice.

4. A premixer in accordance with claim 1, further comprising means for injecting a second gaseous fuel into said shroud flow channel, upstream of said fuel injection orifices for dual fuel operation of said combustion chamber absent flameholding adjacent said fuel injection orifices.

5. A premixer according to claim 1, wherein said combustor achieves low Nox below about 42 ppm, corrected to 15% excess oxygen, due to premixing of said liquid fuel with said compressed air and prevaporizing of said liquid fuel in said premixing region.

6. A premixer in accordance with claim 5 wherein said low Nox is less than about 25 ppm.

* * * * *